US005165615A

United States Patent [19]

Polnik

[11] Patent Number: 5,165,615

[45] Date of Patent: Nov. 24, 1992

[54] TAKE-UP PACKAGE DOFFING APPARATUS FOR TEXTILE YARN PROCESSING MACHINE

[75] Inventor: Arthur Polnik, Viersen, Fed. Rep. of Germany

[73] Assignee: Palitex Project Company GmbH, Krefeld, Fed. Rep. of Germany

[21] Appl. No.: 550,118

[22] Filed: Jul. 9, 1990

[30] Foreign Application Priority Data

Jul. 24, 1989 [EP] European Pat. Off. ..... 89113549.3

[51] Int. Cl.[5] ..... B65H 67/04; D01H 9/10

[52] U.S. Cl. ..... 242/35.50 A; 57/270; 57/281

[58] Field of Search ..... 57/266, 268, 270, 271, 57/275, 281; 242/35.5 A

[56] References Cited

U.S. PATENT DOCUMENTS

| | | | |
|---|---|---|---|
| 3,791,126 | 2/1974 | Kose et al. | 57/270 X |
| 3,940,077 | 2/1976 | Ohashi | 242/35.5 A |
| 4,081,949 | 4/1978 | Keller et al. | 57/268 |
| 4,125,990 | 11/1978 | Stahlecker et al. | 57/270 X |
| 4,138,839 | 2/1979 | Stahlecker et al. | 57/270 |
| 4,139,162 | 2/1979 | Stahlecker | 57/270 X |
| 4,178,748 | 12/1979 | Stahlecker et al. | 242/35.5 A X |
| 4,736,898 | 4/1988 | Raasch et al. | 242/35.5 A X |
| 4,865,260 | 9/1989 | Colli et al. | 57/270 X |
| 4,891,933 | 1/1990 | Raasch | 57/270 X |
| 4,921,180 | 5/1990 | Grecksch et al. | 242/35.5 A |
| 4,923,132 | 5/1990 | Hirai et al. | 242/35.5 A |
| 4,928,476 | 5/1990 | Otashima et al. | 57/270 X |
| 4,977,738 | 12/1990 | Stahlecker | 57/281 |

FOREIGN PATENT DOCUMENTS

| | | |
|---|---|---|
| 2811128 | 12/1978 | Fed. Rep. of Germany . |
| 3824998 | 2/1989 | Fed. Rep. of Germany . |

*Primary Examiner*—Joseph J. Hail, III

*Attorney, Agent, or Firm*—Bell, Seltzer, Park & Gibson

[57] ABSTRACT

For the automated removal of takeup packages, in particular cross-wound twister packages, held in a pivotally supported package holder, and their replacement with empty tubes, the present invention provides for mechanisms to open largely at the same time the package holders on the one hand for the purpose of releasing a takeup package, and to support the takeup package released from its holder on the other hand, and to deliver same to a transport device, and in order to insert a new empty tube into the package holder.

9 Claims, 5 Drawing Sheets

TAKE-UP PACKAGE DOFFING APPARATUS FOR TEXTILE YARN PROCESSING MACHINE

FIELD OF THE INVENTION

The invention relates to an apparatus for the automated exchange of a takeup package, in particular a cross-wound twister package, which is held in horizontal position by a rotatably supported package holder, comprising a first arm and a second arm axially spaced apart and rotatable laterally or respectively vertically to the pivotal motion of the package holder, and which is driven on its circumference by a supporting friction roll, for an empty winding tube, and for the delivery of the takeup package to a transport device.

BACKGROUND OF THE INVENTION

Textile processing machines, and in particular two-for-one twisters, are normally so constructed that a yarn processing station, in particular a twisting spindle, is accommodated in a machine frame in a serviceable manner, since a predominant portion of maintenance and handling work is carried out at such a position. However, in a two-for-one twister, the takeup for the cross-wound twister package is located closer to the center of the machine, i.e., there is a greater distance between the vertical servicing plane and the takeup zone.

OBJECT AND SUMMARY OF THE INVENTION

In view of the foregoing, the object of the present invention is to provide for the removal of a fully wound takeup package, in particular a cross-wound twister package, and its replacement with an empty winding tube measures with regard to process and apparatus, which are able to bridge this distance with the assistance of an automatic maintenance device traveling along the textile machine. Such an automatic maintenance device, however, should not have outwardly projecting elements, which may interfere with the surroundings.

This object is accomplished in accordance with the present invention by providing a take-up package doffing means in a textile yarn processing machine having a plurality of spindle assembly stations in side-by-side arrangement longitudinally along each side of the machine and each including a processed yarn take-up package mechanism having a pair of spaced package tube holders, an actuation lever for pivotally opening the arms to release the wound take-up package, a friction drive roll, a yarn traversing mechanism and a magazine holding empty take-up package tubes, a maintenance device mounted for travel longitudinally along the outside of the machine for selective positioning at each spindle assembly action, and a take-up roll conveyor belt device extending longitudinally of the machine in an upper region between the spindle assembly stations and the take-up package mechanisms on each side of the machine. The take-up package doffing means is carried by the maintenance device and includes means for contacting and moving the actuation lever for pivotally opening the package tube holder arms. The doffing means further includes holding and guide means for removing a fully wound take-up package of yarn from the package tube holder arms and delivering this package of yarn to the take-up roll conveyor belt means. The holding and guide means preferably include two guide and retaining rods mounted parallel to each other and having free end portions bent generally at right angles to the rods and having means mounting the rods for movement out of the maintenance device and into position along each end of the fully wound take-up package of yarn to be removed from the package yarn holder arms so that the bent ends of the rods extend inwardly along the surface of the fully wound take-up package for insuring support and delivery of the fully wound take-up package roll conveyor belt means. The doffing means further includes a tube gripper means for inserting an empty take-up package tube into the package tube holder arms and for removing an empty take-up package tube from the magazine.

BRIEF DESCRIPTION OF THE DRAWINGS

The invention will be described below in greater detail with reference to the drawing, in which.

DETAILED DESCRIPTION OF PREFERRED EMBODIMENT OF THE INVENTION

Figure 1:
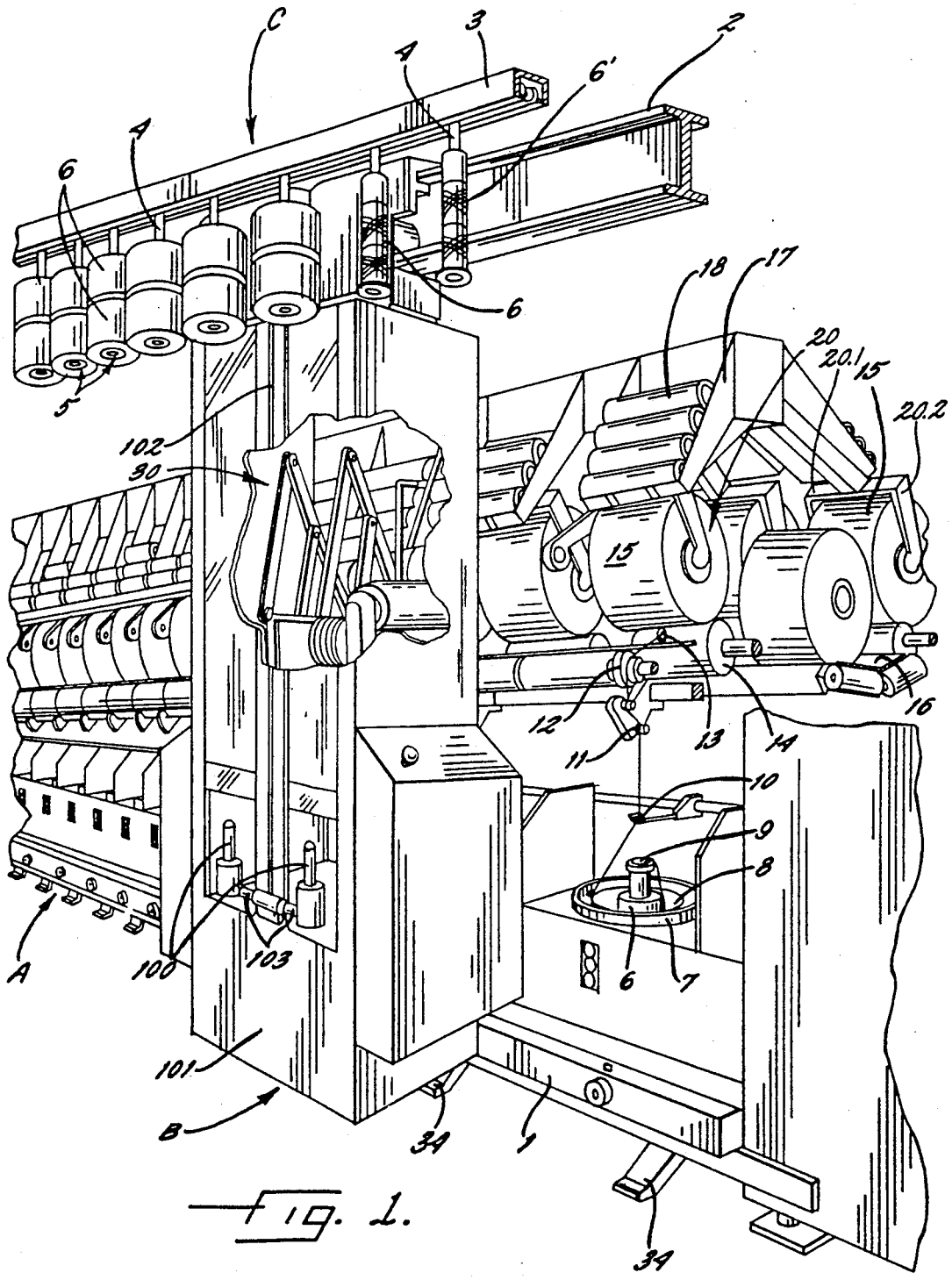
FIG. 1 is a perspective view of a portion of the two-for-one twister with an automatic maintenance device patrolling along this machine.

FIG. 1 shows a portion of a two-for-one twister A, an automatic maintenance device B traveling along the two-for-one twister on lower and upper rails 1 and 2, and an overhead conveyor C.

The overhead conveyor C comprises an upper rail 3, along which a conveyor chain or belt extends with evenly spaced-apart, downward directed suspension holders 4 attached thereto for accommodating package adapters or package transport adapters 5. The suspension holders 4 and package adapters 5 are constructed in known manner, so that during a first upward movement of a package adapter 5, the latter is grasped and held by the suspension holder 4, and released therefrom during a second upward movement and subsequent lowering relative to the suspension holder 4. FIG. 1 shows in the region of the upper rail 3, on the left side, six package adapters 5, each loaded with two fully cross-wound packages or feed yarn packages 6, which are to be delivered by the automatic maintenance device B to the individual twisting positions of the two-for-one twister A, and on the right side, two package adapters 5, each holding two empty tubes 6', which were individually removed by the automatic maintenance device from the twisting positions of the two-for-one twister and delivered to a suspension holder 4. These tubes 6, are transported together with the package and transport adapters 5 by means of the overhead conveyor C to an external loading station, where the adapters 5 can again receive fully wound feed yarn packages or cross-wound packages 6.

The two-for-one twister A comprises several working or twisting positions with the known standard elements, such as a spindle (not shown) in the lower portion, balloon limiter 7, protective pot s, yarn inlet end 9, balloon yarn guide 10, deflecting elements 11 for controlling the yarn winding tension, overfeed element 12, traversing yarn guide 13, and a cross-wound package of the twisted yarn or takeup package 15 driven by friction roll 14. In the center of the machine, a conveyor belt 16 extends in the upper region between the two parallel, longitudinal sides of the machine for the removal of fully wound twister packages 15. Located above each cross-wound twister package or takeup package 15 driven by friction roll 14 is a magazine 17 for empty takeup tubes 18.

Shown inside the protective pot 8 is an upper, only partially cross-wound package or feed yarn package 6 of a pair of packages inserted into the twisting position. From the feed yarn packages, the yarns are withdrawn upward and guided through the yarn inlet end 9 into the lower spindle portion to a yarn storage disk, whence the two combined yarns advance to balloon yarn guide 10 while forming a yarn balloon, and subsequently, after passing deflection rolls 11 and overfeed roll 12, onto a takeup package 15, which is driven by a friction roll 14.

The automatic maintenance device B routinely travels in front of the two-for-one twister A or its individual twisting positions respectively. FIG. 1 shows a schematic detail view of a handling element, which is a package doffing or tube exchange mechanism 30 as well as two mandrels 100 for feed yarn and unwound units, which are adapted to rotate about a vertical axis, and to move upward and downward in vertical direction.

Foot pedals 34 below each twisting position serve for a prepared operation or maintenance of the individual twisting positions.

The present invention deals with the package doffing mechanism 30, first, to remove fully wound twisted yarn packages 15 from a package holder 20 and to deliver same to a conveyor belt 16 or any other suitable means for removing finished twister packages 15, and, second, to insert again empty winding tubes 18 from the magazine 17 into the package holder 20.

Figure 2:
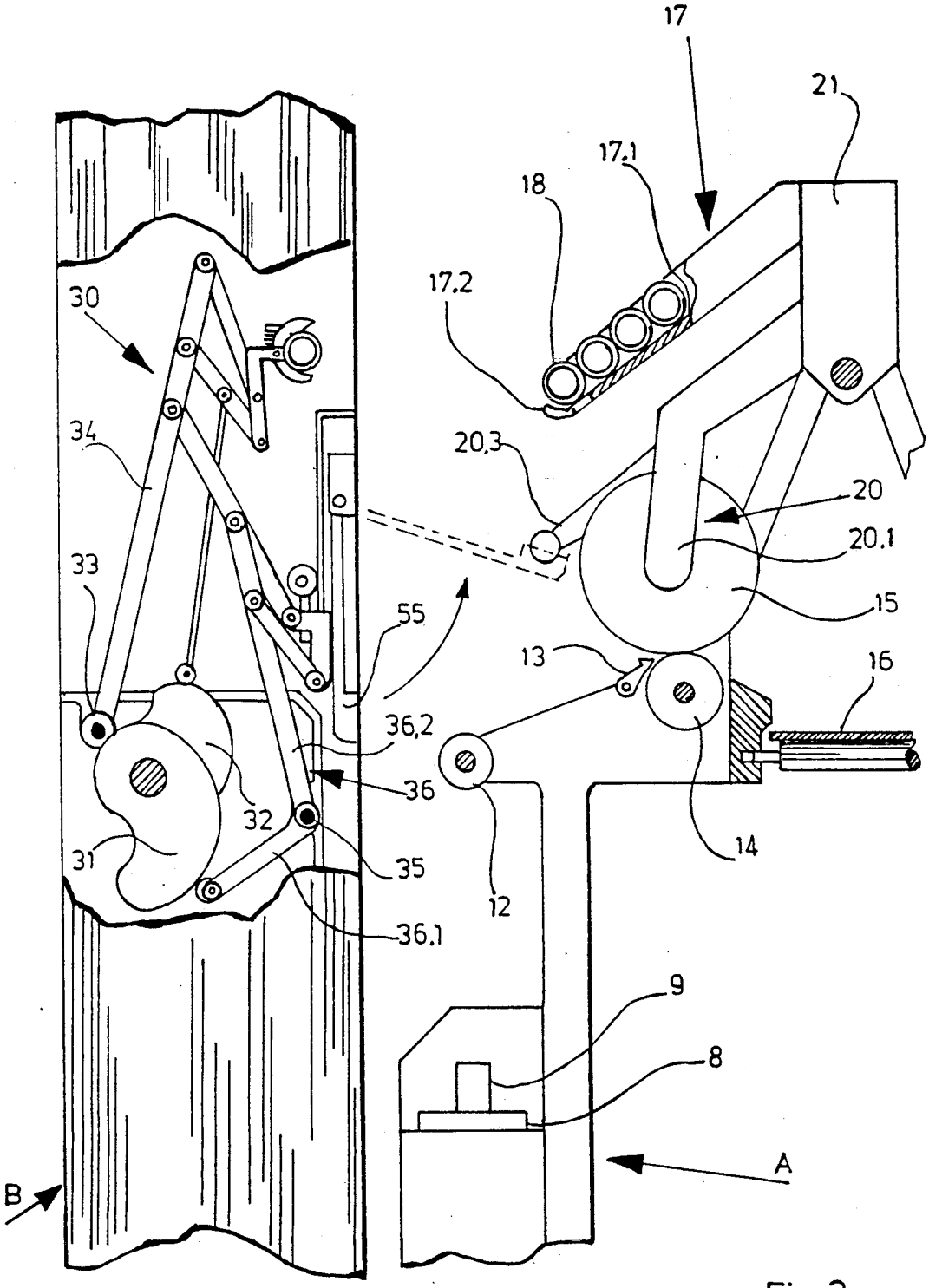
FIG. 2 is a partially sectional side view of the package doffing mechanism arranged at a twisting position of a two-for-one twister.

FIG. 2 shows as standard elements of the two-for-one twister A portions of a two-for-one twisting spindle, such as a protective pot 8 and a yarn inlet end 9, and in the region of package takeup, an overfeed roll 12, a traversing yarn guide 13, a friction roll 14 to drive a takeup or cross-wound twister package 15, which is supported between two arms 20.1 and 20.2 of the package holder 20, a standard actuation lever 20.3 to open the package holder 20 by laterally pivoting one of the two arms 20.1 or 20.2, as well as a tube magazine 17, which comprises an obliquely downward inclined surface 17.1 and a front holding element 17.2 to retain a supply of empty winding tubes 18. Both the package holder 20 and tube magazine 17 are supported on a longitudinal beam 21 of the machine frame.

The following description will refer both to the constructional details of the package doffing mechanism 30 of the present invention and to the operating steps and functions of the individual elements of the present invention.

A doffing operation is divided substantially into three steps, namely:

1. Removal of a fully wound twister package 15 from the package holder 20 and delivery of same to the conveyor belt 16;

2. Insertion of an empty tube 18 into the package holder 20; and

3. Removal of a new empty tube from the magazine 17.

According to the present invention, of these three operating steps, the first two occur largely at the same time and proceed parallel to each other.

The package doffer 30 of the present invention comprises a multijoint linkage, which is controlled by cams 31 and 32 preferably driven by an electric motor. The multijoint linkage comprises a main lever 34 rotatable about a horizontal axis 33 stationarily supported in the automatic maintenance device B, as well as a two-arm lever 36, which is likewise rotatable about a horizontal axis 3$ and comprises a control arm 36.1 moving along the edge of cam 31, and a hinged arm 36.2, both arms 36.1 and 36.2 forming in the illustrated embodiment an angle of substantially 120°.

The upper end 34.1 of the main lever 34 forms between the two joints 34.2 and 34.3 the one bar of a four-joint linkage, which is articulated to the two joints 34.2 and 34.3 and comprises two additional bars 37 and 38, as well as an additional bar 39 connected at the ends of these two bars 37 and 38 in joints 37.1 and 38.2. Attached to this bar 39 is an empty tube gripper 40, which projects beyond the joint 38.2. This empty tube gripper 40 comprises substantially, see in particular FIG. 4, two arms 42 rotatable about a common axis 41, which can be opened against the force of a return spring 43 so as to grasp an empty tube 18.

Jointed to the lower bar 37 of this first upper four-joint linkage is a control arm 44, the free end of which rests under the load of a spring against the edge of cam 32.

The free end 36.3 of the hinged arm 36.2 forms between the joints 45 and 46 the one bar of a second, lower four-joint linkage. Attached in the two joints 45 and 46 are bars 47 and 48, with bar 48 having a projection 48.1, which extends beyond joint 46 and is connected to the main lever 34 in joint 34.4.

A further bar 49 is jointed to the free ends of the two hinged bars 47 and 48.

As to the individual four-joint linkages including the main lever 34 and hinged arm 36.2 it should be noted that these systems are duplicated, one parallel to the other at a lateral distance, so as to increase the stability of the entire linkage. The control arms 36.1 and 44 are each provided as a single element on one side of the linkage, so that consequently only one cam system is needed, further cams being provided beside the two cams 31 and 32, so as to control motions, which will be described hereinbelow.

Figure 4:
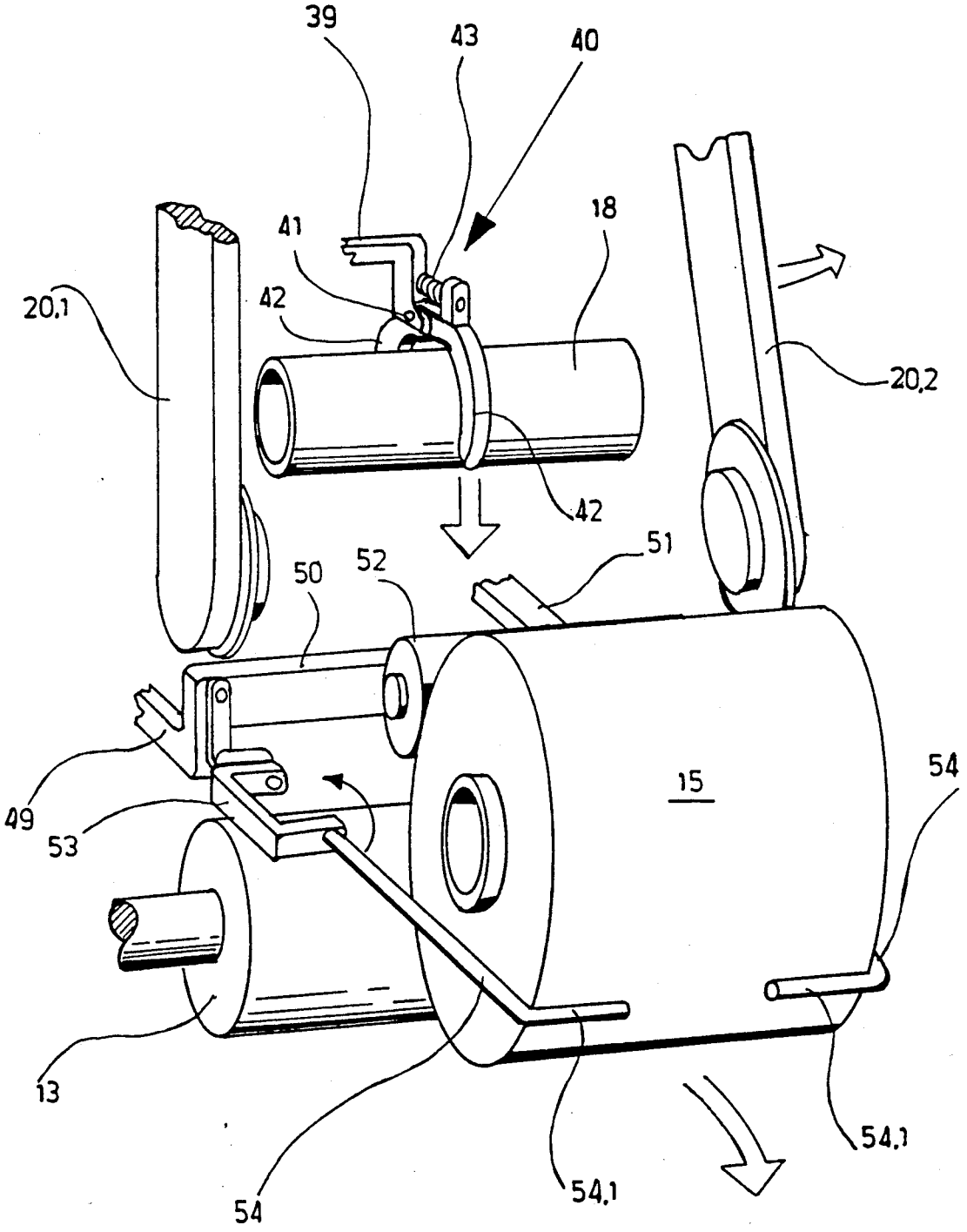
FIG. 4 is a perspective view of the holding and guide means of the present invention to support a fully wound takeup package.

This double or two-sided arrangement of the individual hinged bars is shown in FIG. 4, for example, for the hinged bars 49, whose ends are interconnected by a cross bar 50, on which a supporting roll 52 is arranged, substantially in the center between the two package holder arms 20.1 and 20.2, by means of a carrying arm 51. Pivotally supported at the ends of the two hinged bars 49 are cam-controlled holders 53 for the guide and retaining rods 54, whose free ends 54.1 are bent inwardly substantially at a right angle. The spacing between the two guide and retaining rods 54 corresponds substantially to a fully wound twister package 15.

Also hinged to the automatic maintenance device B is an arm 55 to open a package holder, which is adapted to pivot in a vertical plane in direction of the two-for-one twister A or toward a spindle to be serviced. This opening arm 55 is in addition cam-controlled and adapted to pivot sideways.

The working method of the package doffer integrated in an automatic maintenance device B is substantially as follows:

After the automatic maintenance device B has been properly positioned in front of a spindle or twisting position to be serviced, opening arm 55 moves out in direction of package holder 20, so as to contact with its preferably cup-shaped end from the bottom the actuation lever 20.3 of the one package holder arm 20.2, which is adapted to move outward to the side.

Figure 3:
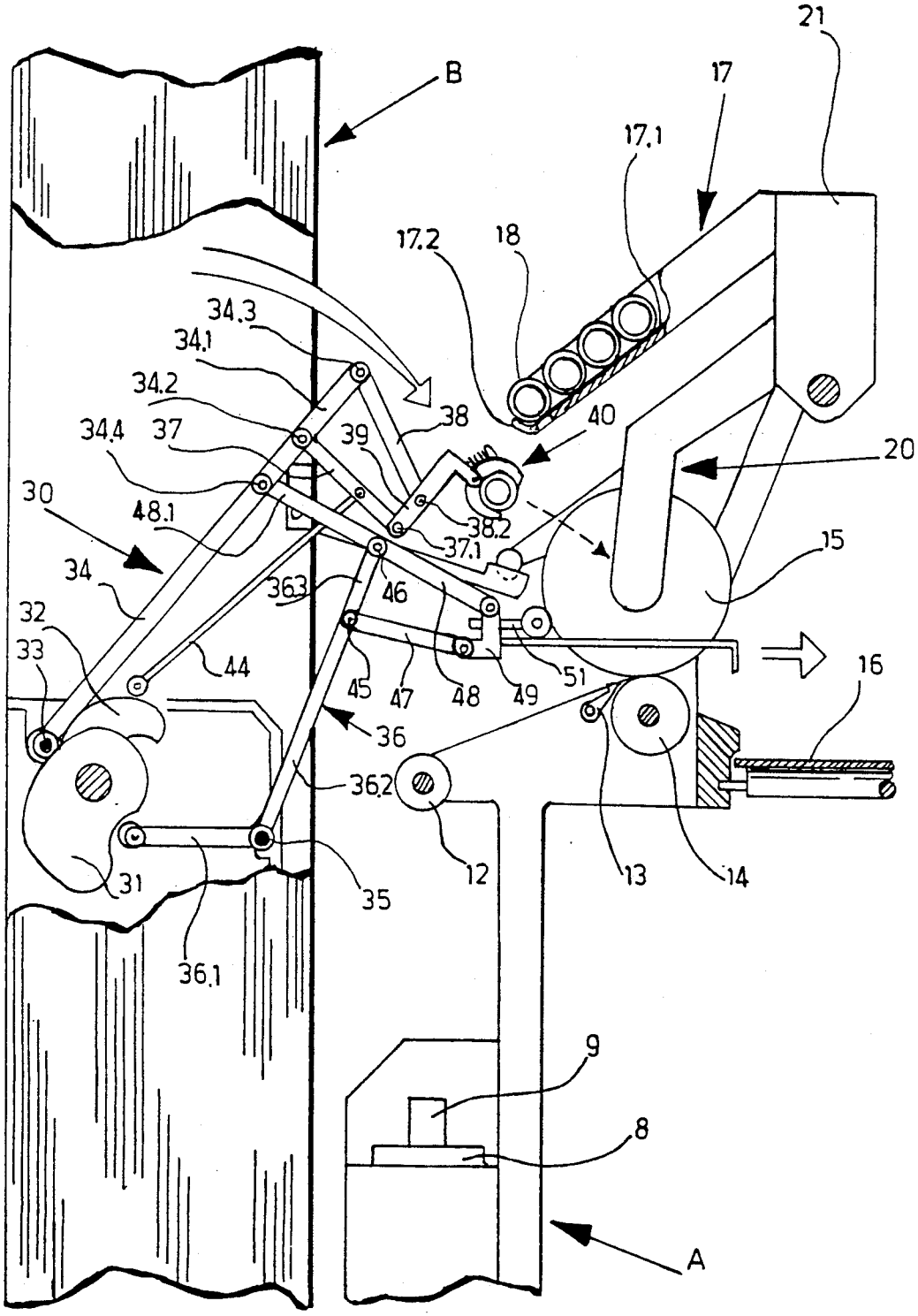
FIG. 3 is a view corresponding to the illustration of FIG. 2 with the package doffing mechanism far moved out of the automatic maintenance device.

Substantially at the same time as the opening arm 55 moves out, the four-joint linkage is moved out of the automatic maintenance device B, controlled by cam 31. In doing so, the two guide and retaining rods 54 are laterally moved, in a first operating step shown in particular in FIG. 3, past the two front ends of the fully wound twister package 15, with their angled ends 54.1 assuming a vertical position. As soon as these guide and retaining rods 54 have moved with their angled ends 54.1 beyond the package periphery directed toward the center of the machine, the rods 54 rotate, controlled by cams, about their longitudinal axis in such a manner that the two angled ends 54.1 assume substantially a horizontal position (see FIG. 4). As a result the package is held or supported on the sides in the region of its two front end surfaces by the rods 54 and likewise held or supported in the region of its periphery by the angled ends 54.1.

A second task of the one rod 54 is to displace the package slightly to the side, away from the right-hand package plate, in that the right-hand rod 54 touches the front side of the package.

Subsequently, the opening arm 55 moves relative to the package holder 20 laterally outwardly, thereby also moving the arm 20.2 to the outside, so that the package 15 is released from the holder 20 and supported by the friction roll 14 located therebelow. As the multi-joint linkage moves out further, the support roll 52 contacts the periphery of the package 15. As the multijoint linkage continues to move out, the package is pushed toward the center of the machine and rolls onto the conveyor belt 16, while still being held by the angled ends 54.1 on its side directed to the center of the machine. The package 15 is placed on the conveyor belt 16, when the multijoint linkage assumes its extreme position. In so doing, it is essential that, during the entire transfer time, the fully wound twister package 15 is held or guided on its side by the rods 54, and in the region of its periphery by the angles ends 54.1, on the one hand, and by the support roll 52 on the other, thereby ensuring a careful handling of the package.

Parallel to the stretching movement of the lever mechanism or multijoint linkage for the transfer of a fully wound twister package from the region of the takeup to the conveyor belt, the empty tube gripper 40, which has already removed an empty tube 18 from the magazine 17 during the preceding cycle, is likewise put into motion in direction of the package holder or in direction of the axis of rotation of the axisless package holder 20. This empty tube gripper 40 is arranged on the upper four-joint linkage 34.1, 37, 38 and 39, whose motional impulses are controlled by cam 32 via control arm 44. However, the movement of the upper four-joint linkage is also coupled with the movement of the second, lower four-joint linkage via the extension 48.1, substantially in such a manner that, during a forward movement of the lower four-joint linkage, the empty tube gripper 40 is able to follow substantially behind the full package.

For the purpose of inserting a new winding tube 18 into the package holder 20, the movements of the opening arm 55 and of the gripper 40 are adapted to each other so that the package holder with its arm 20.2 opened, i.e., laterally moved out, is locked in a position, which the tube gripper is able to reach during the forward movement of the linkage mechanism. As soon as the gripper reaches a position corresponding to the axis center of the package holder, its arm 20.2 previously moved outward, is returned to its holding position by a corresponding cam-controlled actuation of the opening arm 55, so that the newly inserted winding tube is held in a centered position between corresponding centering plates of the package holder.

Subsequently, the opening arm 55 can be returned to its initial position, whereby the package holder is lowered until the new empty tube contacts again the friction roll 14.

It is possible to return simultaneously the linkage during the downward directed pivotal movement of the opening arm 55. Before or while the linkage returns or retracts, the lateral guide rods 54 are rotated, controlled by cams, back to their original position, in which their angled ends 54.1 assume each their vertical position, so that it is again possible to move these rods 54 past the front sides of the new empty tube.

Figure 5:
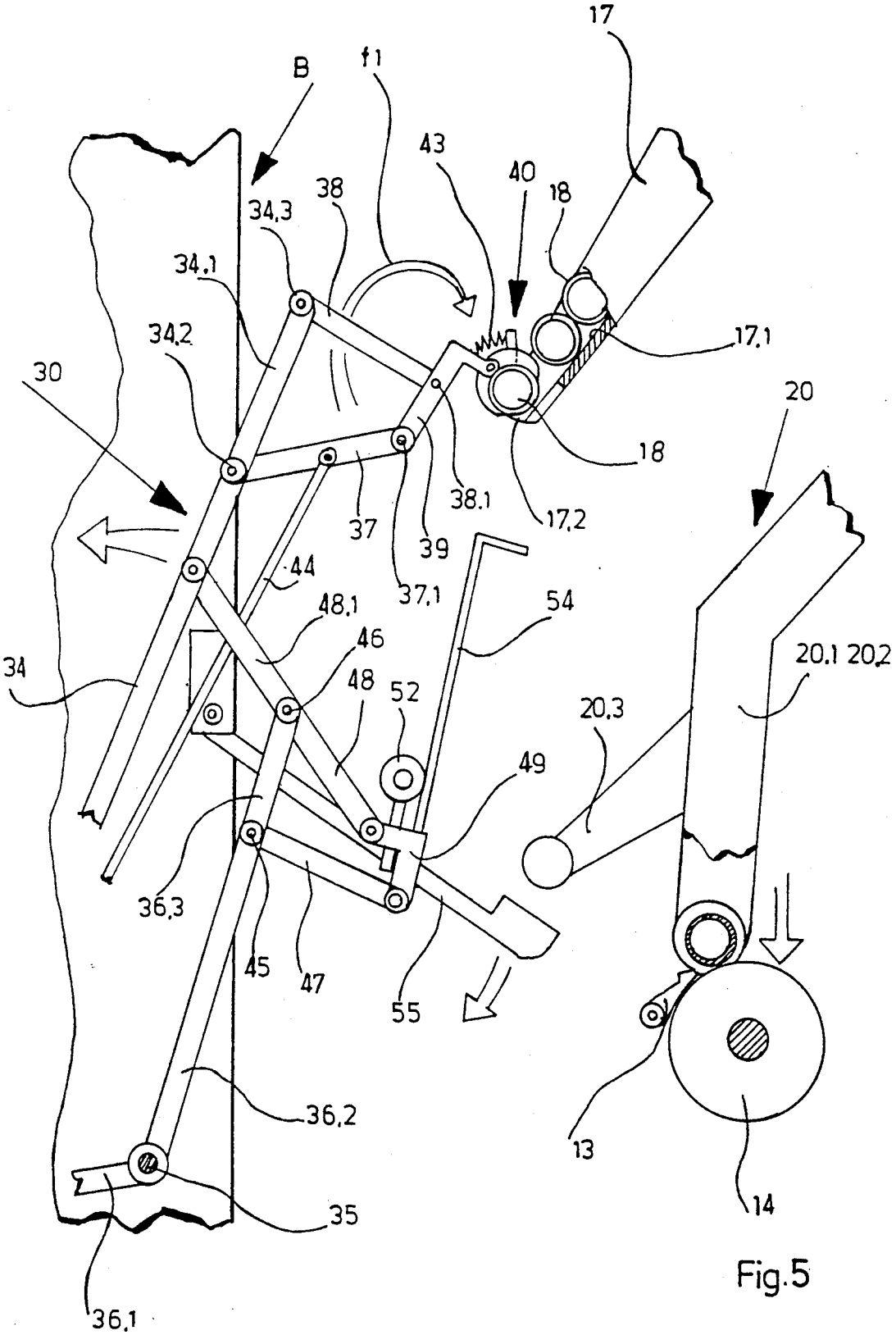
FIG. 5 is a view comparable to the illustrations of FIGS. 2 and 3 at the time an empty tube is removed from a magazine.

Shortly before reaching its end position in the automatic maintenance device B, the linkage is stopped, so as to remove another empty tube 18 from the magazine 17. To this end, the cams are provided with corresponding guide tracks, which are so shaped that the upper four-joint linkage perform substantially a pivotal movement as indicated by arrow f1 in FIG. 5. The arms 42 of gripper 40 are designed and constructed in such a manner and are under the action of return spring 43 such that these arms 42 open automatically against the force of return spring 43, when the arms are pushed over an empty tube. The gripper closes by the action of the return spring 43, as soon as the front ends of its arms are moved beyond a center plane extending through the tube axis. Prerequisite to the opening of the gripper for the purpose of releasing a tube is that such a tube is clamped in the package holder, and that the gripper is moved away from the tube by the return motion of the linkage.

An essential aspect of the apparatus of the present invention is to be found in the largely simultaneous and parallel working method of the different gripping and actuating mechanisms. Thus, the removal of a full package and the directly succeeding insertion of an empty tube is largely possible in one operation. During the transfer of a full twister package, same is guided or supported safely and carefully from the time the package holder is opened and moved until the final delivery to the package conveyor belt.

What is claimed is:

1. A textile yarn processing machine having a plurality of spindle assembly stations in side-by-side arrangement longitudinally along each side of said machine and each including a processed yarn take-up package mechanism having a pair of spaced package tube holder arms, an actuation lever for pivotally opening said arms to release the wound take-up package, a friction drive roll, a yarn traversing mechanism and a magazine holding empty take-up package tubes; a maintenance device mounted for travel longitudinally along the outside of said machine for selective positioning at each spindle assembly station; and a take-up roll conveyor belt means extending longitudinally of said machine in an upper region between said spindle assembly stations and said take-up package mechanisms on each side of said machine; the combination therewith of take-up package doffing means carried by said maintenance device and including means for contacting and moving said actuation lever for pivotally opening said package tube holder arms, holding and guide means for removing a fully wound take-up package of yarn from said package tube holder arms and delivering this package of yarn to said take-up roll conveyor belt means, and a tube gripper means for inserting an empty take-up package tube into said package tube holder arms and for removing an empty take-up package tube from said magazine, said holding and guide means including two guide and retaining rods mounted parallel to each other and having free end portions bent generally at right angles to said rods and having means mounting said rods for movement out of said maintenance device and into position along each end of the fully wound take-up package of yarn to be removed from said package tube holder arms so that said bent ends of said rods extend inwardly along the surface of the fully wound take-up package for insuring support and delivery of the fully wound take-up package from said package tube holder arms to said take-up roll conveyor belt means.

2. A textile yarn processing machine, as set forth in claim 1, in which said means for contacting and moving said actuation lever comprises an arm and means mounting said arm for movement out of said maintenance device and into contact with said actuation lever.

3. A textile yarn processing machine, as set forth in claim 2, in which said arm of said means for contacting and moving said actuation lever includes a cup-shaped end.

4. A textile yarn processing machine, as set forth in claim 1, including means mounting said guide and retaining rods to be spaced apart a distance substantially equal to the length of a fully wound take-up package of yarn.

5. A textile yarn processing machine, as set forth in claim 1, in which said holding and guide means for removing a fully would take-up package of yarn from said package tube holder arms and delivering this package of yarn to said take-up roll conveyor belt means further includes supporting roll means mounted for movement with said guide and retaining rod means for contacting the surface of the fully wound take-up package of yarn being removed from said package tube holder arms and delivered to said take-up roll conveyor belt means.

6. A textile yarn processing machine, as set forth in claim 5, in which said means mounting said guide and retaining rods for movement includes a multijoint linkage means having one end thereof mounted in said maintenance device and the other end thereof adapted for movement out of said maintenance device and carrying said guide and retaining rods and said supporting roll, and cam means operatively connected with said multijoint linkage for controlling movement thereof.

7. A textile yarn processing machine, as set forth in claim 6, in which said tube gripper means includes a multijoint linkage means having one end thereof mounted in said maintenance device and having the other end thereof adapted for movement out of said maintenance device, a gripper device carried by the other end of said multijoint linkage, and cam means operatively connected with the one end of said multijoint linkage for controlling movement thereof.

8. A textile yarn processing machine, as set forth in claim 7, in which both of said multijoint linkages are interconnected for coordinated movement thereof.

9. A textile yarn processing machine, as set forth in claim 1 or 8, in which said tube gripper means comprises two arms rotatable about a common axis and spring means connected between said arms for biasing said arms into a closed position for gripping an empty take-up tube and for releasing the take-up tube against the bias of said spring.

* * * * *

UNITED STATES PATENT AND TRADEMARK OFFICE

CERTIFICATE OF CORRECTION

PATENT NO. : 5,165,615

DATED : November 24, 1992

INVENTOR(S) : Arthur Polnik

It is certified that error appears in the above-identified patent and that said Letters Patent is hereby corrected as shown below:

Column 1, line 55, "action" should be -- station --.

Column 2, line 9, after "package" insert -- from the package tube holder arms to the take-up --.

Column 2, line 61, "6" should be -- 6' --.

Column 3, line 2, "s" should be -- 8 --.

Column 4, line 13, "3$" should be -- 35 --.

Column 8, line 5, "would" should be -- wound --.

Signed and Sealed this

Ninth Day of November, 1993

*Attest:*

*Attesting Officer*

BRUCE LEHMAN

*Commissioner of Patents and Trademarks*